United States Patent [19]

Shiozawa et al.

[11] Patent Number: 4,458,652

[45] Date of Patent: Jul. 10, 1984

[54] DISTRIBUTOR TYPE FUEL INJECTION PUMP HAVING INJECTION TIMING CONTROL DEVICE ADAPTABLE TO INTERNAL COMBUSTION ENGINES WITH A WIDE RANGE OF NUMBER OF CYLINDERS

[75] Inventors: Osamu Shiozawa; Hachiro Aoki; Seizi Takahashi, all of Higashimatsuyama, Japan

[73] Assignee: Diesel Kiki Co., Ltd., Tokyo, Japan

[21] Appl. No.: 501,163

[22] Filed: Jun. 6, 1983

[30] Foreign Application Priority Data

Jun. 16, 1982 [JP] Japan ..... 57-89814

[51] Int. Cl.[3] ..... F02M 59/20

[52] U.S. Cl. ..... 123/502; 123/449; 417/221

[58] Field of Search ..... 123/502, 501, 500, 495, 123/449; 417/221, 462

[56] References Cited

U.S. PATENT DOCUMENTS

| | | | |
|---|---|---|---|
| 2,999,487 | 9/1961 | Stier | 123/502 |
| 4,177,775 | 11/1979 | Hofer | 417/462 |
| 4,320,733 | 3/1982 | Mowbray | 123/501 |
| 4,329,962 | 5/1982 | Johnston | 123/502 |
| 4,376,432 | 3/1983 | Davis | 123/501 |
| 4,387,688 | 6/1983 | Eheim | 123/502 |

*Primary Examiner*—Charles J. Myhre
*Assistant Examiner*—Carl Stuart Miller
*Attorney, Agent, or Firm*—Frishauf, Holtz, Goodman & Woodward

[57] ABSTRACT

A distributor type fuel injection pump which is provided with an eccentric connecting member coupling the timer piston of the injection timing control device to the roller holder. The eccentric connecting member comprises a first portion and a second portion eccentrically combined together. The first portion engages with the roller holder to support a predetermined one of the rollers on the roller holder, which is rotatably fitted thereon, whereas the second portion pivotably engages with the timer piston. Further provided is means for prohibiting pivotal movement of the second portion of the eccentric connecting member about the first portion of same relative to the roller holder. Displacement of the timer piston causes accurately corresponding circumferential displacement of the roller holder through the eccentric connecting member and the pivotal movement-prohibiting means to thereby achieve accurate control of the injection timing in response to the rotational speed of the engine.

10 Claims, 14 Drawing Figures

DISTRIBUTOR TYPE FUEL INJECTION PUMP HAVING INJECTION TIMING CONTROL DEVICE ADAPTABLE TO INTERNAL COMBUSTION ENGINES WITH A WIDE RANGE OF NUMBER OF CYLINDERS

BACKGROUND OF THE INVENTION

This invention relates to a distributor type fuel injection pump for internal combustion engines, and more particularly to a fuel injection pump of this type which is equipped with an injection timing control device adapted for use with internal combustion engines with a wide range of number of cylinders.

In a distributor type fuel injection pump for Diesel engines, it is necessary to vary the fuel injection timing in dependence upon the rotational speed of the engine so as to inject fuel into each engine cylinder at an appropriate time relative to the position of the piston in the cylinder. To this end, the conventional fuel injection pump is provided with an injection timing control device generally called "a timer". A distributor type fuel injection pump provided with such injection timing control device generally includes a drive shaft arranged for rotation at speeds dependent upon the engine rotational speed, a pumping plunger rotatively coupled to the drive shaft, a cam disc secured to one end of the plunger, a roller holder carrying a plurality of rollers disposed in urging contact with the cam disc and allowed to rotate through a limited angle, and a timer piston drivingly coupled to the roller holder and actuatable in response to fuel oil pressure variable in response to the rotational speed of the engine. The fuel injection pump operates such that when the drive shaft rotates at speeds dependent upon the engine rotational speed, the plunger is made to rotate and reciprocate at the same time due to the action of the mutually engaging cam disc and rollers, while simultaneously a change in the fuel oil pressure dependent upon the engine rotational speed causes displacement of the timer piston, which in turn causes circumferential displacement of the roller holder, resulting in a change in the position of contact between the rollers on the roller holder and the cam disc so that the acting point of the plunger changes with respect to the circumferential phase of the drive shaft to thereby control the fuel injection timing.

It is a general tendency in recent years for Diesel engines to become more compact in size. For instance, Diesel engines having a total stroke volume of the order of 1,000 cc are under development. Most of such compact Diesel engines are intended to be designed with three cylinders, so as to meet with large demand for such type. Also fuel injection pumps to be applied to such three-cylinder Diesel engines have to be designed as the three-cylinder type.

However, conventional distributor type fuel injection pumps, most of which are the four-cylinder type, are very difficult to convert into the three-cylinder type, owing to its structural handicap. That is, to convert a fuel injection pump of this type into the three-cylinder type, three rollers, which are to engage with the cam disc, have to be arranged on the roller holder at circumferentially equal intervals, i.e. intervals of 120 degrees. However, the roller holder has its upper edge portion formed with a large cut for avoiding interference of the roller holder with its adjacent parts. Further, the roller holder has its lower central edge portion occupied by a connecting lever which couples the roller holder with the timer piston. Therefore, it is impossible to arrange one of the three rollers either at the upper edge portion of the roller holder or at the lower central edge portion of same.

In view of this structural handicap, it has conventionally been employed to convert a distributor type fuel injection pump for six-cylinder type engines into the three-cylinder type. However, this converted fuel injection pump has various disadvantages. An injection timing control device which has eliminated such disadvantages has been proposed by U.S. Ser. No. 467,787, assigned to the assignee of the present application. According to this proposed injection timing control device, the timer piston and the roller holder are coupled together by means of an eccentric connecting member comprising a first portion and a second portion combined together in eccentricity with each other, the first portion supporting one of the rollers rotatably fitted thereon at a lower central edge portion of the roller holder and the second portion pivotally engaging with the timer piston. Displacement of the timer piston causes circumferential displacement of the roller holder through the eccentric member, to thereby change the injection timing of fuel into the engine. This proposed eccentric connecting member can adapt a conventional distributor type fuel injection pump of this kind to engines with a wide range of number of cylinders inclusive of the three-cylinder type.

However, according to this proposed eccentric connecting member, as the timer piston is moved, turning moment acts upon the second portion of the eccentric connecting member to cause pivotal movement of the same portion about the axis of the first portion, thus impeding circumferential displacement of the roller holder accurately corresponding to displacement of the timer piston, resulting in inaccurate control of the injection timing.

SUMMARY OF THE INVENTION

It is the object of the invention to provide a distributor type fuel injection pump which is adaptable to internal combustion engines with any number of cylinders inclusive of the three-cylinder type without requiring any modification of the other component parts of the pump, by employing an eccentric connecting element which can supersede one of the conventional pins or shafts supporting the rollers on the roller holder and the conventional connecting lever coupling the roller holder with the timer piston, and which is also provided with pivotal movement-prohibiting means for prohibiting lateral dislocation or pivotal movement of the eccentric connecting member which can take place concurrently with displacement of the timer piston, thereby enabling to achieve accurate injection timing control.

According to the present invention, connecting means coupling the roller holder with an element (timer piston) of the fuel injection timing control device, which is displaceable in response to the rotational speed of the engine, comprises an eccentric connecting member having a first portion and a second portion eccentrically combined together. The first portion of the eccentric connecting member engages with the roller holder and supports a predetermined one of the rollers carried on the roller holder, which is rotatably fitted on the first portion, whereas the second portion of the eccentric connecting member pivotably engages with the above displaceable element of the fuel injection timing control device. Further provided is pivotal movement-prohibiting means which prohibits pivotal movement of the second portion of the eccentric connecting member about the axis of the first portion relative to the roller holder. Displacement of the displaceable element causes accurately corresponding displacement of the roller holder through the eccentric connecting member to theerby achieve accurate control of the injection timing in response to the rotational speed of the engine.

The above and other objects, features and advantages of the invention will be more apparent from the ensuing detailed description taken in connection with the accompanying drawings.

DETAILED DESCRIPTION

Figure 1:
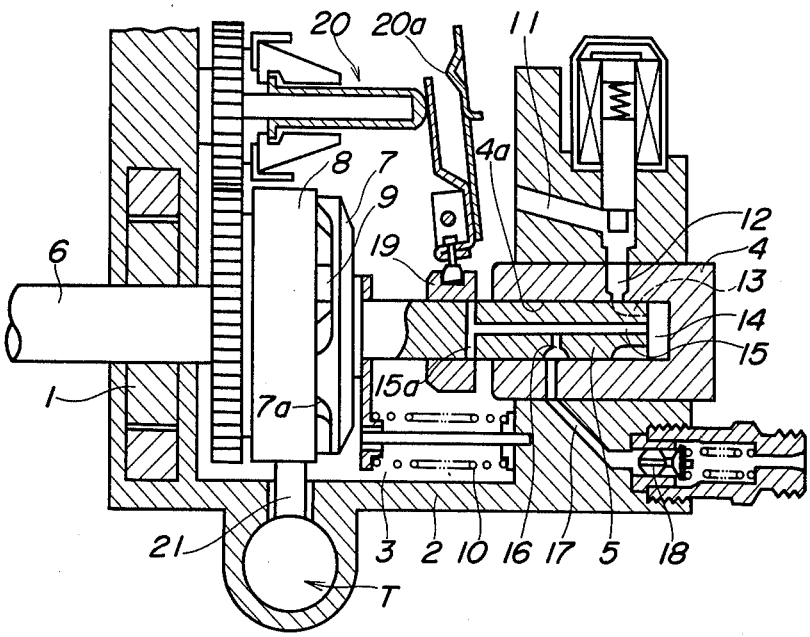
FIG. 1 PRIOR ART
FIG. 1 is a schematic longitudinal sectional view of essential part of a conventional distributor type fuel injection pump to which the present invention is applicable.
Figure 2:
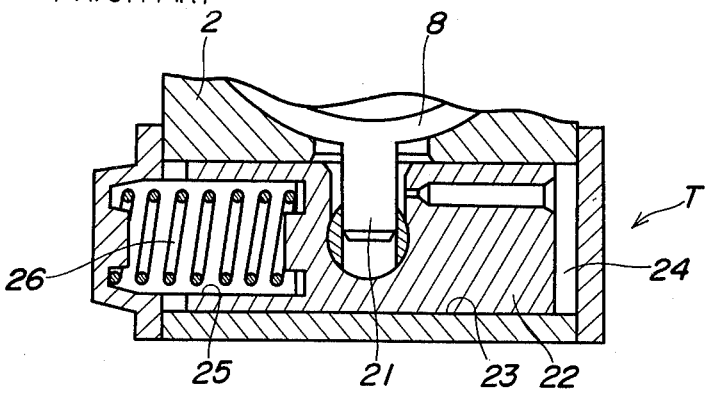
FIG. 2 PRIOR ART
FIG. 2 is a fragmentary cross-sectional view of the fuel injection pump of FIG. 1, illustrating the injection timing control device provided on the same pump.

Referring first to FIGS. 1 and 2, there is illustrated a distributor type fuel injection pump which is conventionally used. Fuel oil in a fuel tank, not shown, is sucked and pressurized by a feed pump 1, and delivered to a suction chamber 3 defined within a pump housing 2. The internal pressure or fuel pressure within the suction chamber 3 is controlled to a value dependent upon the rotational speed of an engine associated with the pump, by means of a pressure regulating valve, not shown, such that the internal pressure increases proportionately to an increase in the engine rotational speed, for instance.

A pumping plunger 5 for pumping and distributing actions is slidably received within a cylinder bore 4*a* formed within a plunger barrel 4 mounted in the pump housing 2, to make simultaneous reciprocating and rotative motions by means described below. A drive shaft 6 is drivingly coupled to a cam disc 7 secured to the rear end of the plunger 5, by means of a driving disc, not shown, such that the plunger 5 rotates in unison with the rotating drive shaft 6. The cam disc 7 has a camming surface 7*a* formed with highs corresponding in number to the cylinders of the engine (four in the illustrated embodiment), which surface is urged against four rollers 9 carried on a roller holder 8 and circumferentially arranged, by a spring 10. Thus, as the drive shaft 6 rotates, the plunger 5 is caused to make a reciprocating motion for suction and pressure delivery of fuel and a rotative motion for distribution of fuel to delivery valves 18, at the same time.

When the plunger 5 is moved through each suction stroke, fuel in the suction chamber 3 is supplied into a pump working chamber 14 through a fuel feeding line 11, a suction port 12, and one of suction grooves 13 formed in the outer peripheral surface of tip of the plunger 5 and then registering with the suction port 12. When the plunger is moved through the following delivery stroke, the suction port 12 and the above suction groove 13 are disconnected from each other by the plunger 5 so that the fuel in the pump working chamber 14 is pressurized to be fed through a central axial bore 17 and a distributing port 16, both formed in the plunger 5, and through one of passages 17 and one of the delivery valves 8, both corresponding in number to the engine cylinders and provided in the pump housing 2, to be injected into one of the engine cylinders through an injection nozzle, not shown.

A control sleeve 19 is slidably fitted on a portion of the plunger 5 projected into the suction chamber 3. During the delivery stroke of the plunger 5, when a cut-off port 15*a* formed in the plunger 5 in communication with the central axial bore 15 becomes disengaged from the control sleeve 19 to open into the suction chamber 3, the pressurized fuel within the plunger 5 flows into the suction chamber 3 to interrupt the delivery of fuel to the delivery valve 18, terminating the injection. The control sleeve 19 is controlled in axial position on the plunger 5 by means of a governor mechanism, not shown, engaging with the control sleeve 19 via a lever 20, etc. to thereby control the fuel injection quantity.

The roller holder 8 is arranged in concentricity with the plunger 5 and rotatable about its own axis through a limited angle. A connecting lever 21 is connected at its one end to the roller holder 8, and at its other end to the timer piston 22 of an injection timing control device T.

the injection timing control device T is constructed such that the timer piston 22 is slidably received within a cylinder 23 formed at the bottom of the pump housing 2 and extending at right angles to the axis of the roller holder 8, and defined within the cylinder 23 at opposite ends of the piston 22 are a pressure working chamber 24 into which the fuel pressure is supplied from the suction chamber 3, ad a chamber 25 in which a timer spring 26 is accommodated. The position of the timer piston 22 is determined by the relationship between the force of the timer spring 26 and the fuel pressure, which in turn determines the circumferential position of the roller holder 8 through the connecting lever 21. A change in the circumferential position of the roller holder 8 causes a change in the position of contact between the rollers 9 and the camming surface 7a of the cam disc 7, which in turn causes a change in the relationship between the circumferential phase of the drive shaft 6 and the above position of contact, i.e. the acting point of the plunger 5, so that there occurs a change in the injection timing with respect to the angle of rotation of the drive shaft 6. For instance, when an increase in the fuel pressure forces the timer piston 22 to be moved against the force of the timer spring 26 in a direction normal to the axis of the roller holder 8, the roller holder 8 is rotated clockwise as viewed in FIG. 2 to advance the injection timing.

To design the above-mentioned conventional distributor type fuel injection pump for use with a three-cylinder engine, it is necessary to arrange three rollers 9 on the roller holder 8 at circumferentially equal intervals. However, an arcuate notch (corresponding to a notch 81 appearing in FIG. 3) is formed in an upper edge portion of the roller holder 8 to avoid interference of the roller holder 8 with a coupling gear, not shown, which drivingly couples the drive shaft 6 with the governing mechanism, not shown, which makes it impossible to arrange a roller at the above upper edge portion. Therefore, to mount three rollers on the above notched roller holder 8, two of the three rollers have to be located at the opposite sides of the notch in the upper edge portion and one at a central lower edge portion of the roller holder 8, respectively. However, the presence of the aforementioned connecting lever 21 coupling the roller holder 8 with the timer piston 22 prevents arrangement of one of the rollers at the central lower edge portion of the roller holder 8. Therefore, conventionally, as tentative measures, a distributor type fuel injection pump for a six cylinder engine is modified for use with a three-cylinder engine. However, even such converted fuel injection pump provides various disadvantages and is still unsatisfactory.

Figure 3:
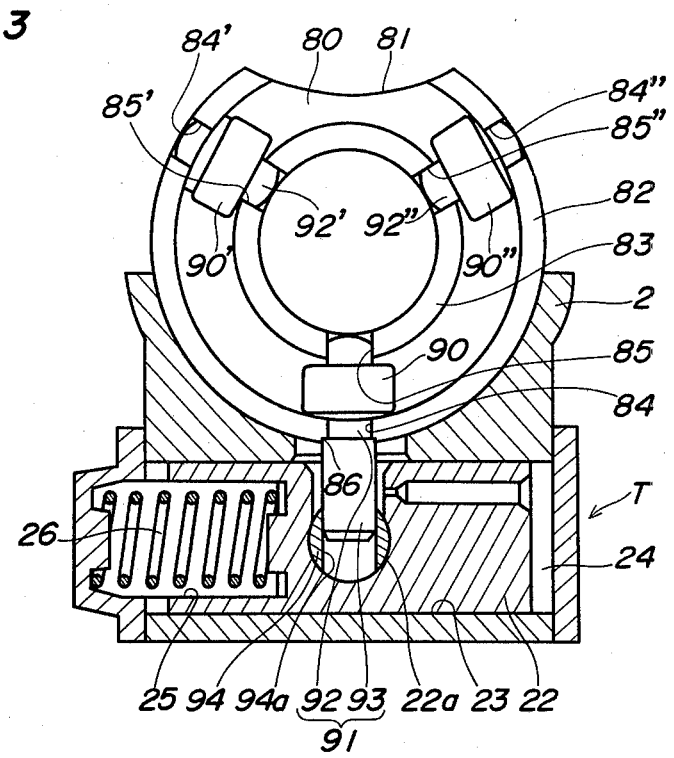
FIG. 3 is a fragmentary cross-sectional view of essential part of a distributor type fuel injection pump according to a first embodiment of the present invention.
Figure 4:
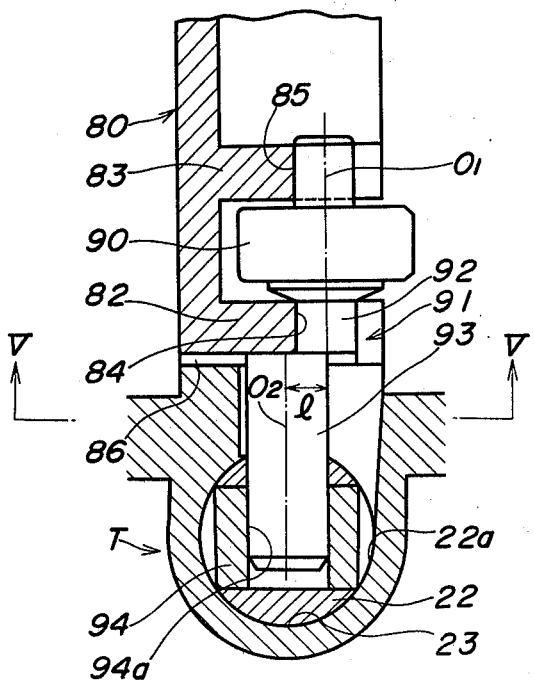
FIG. 4 is a fragmentary sectional view, on an enlarged scale, of the eccentric connecting member in FIG. 3.

Referring next to FIGS. 3 through 6, there is illustrated a section of the roller holder and injection timing control device of a distributor type fuel injection pump according to a first embodiment of the invention. In FIG. 3, a roller holder 80, which corresponds to the roller holder 8 in FIGS. 1 and 2, carries three rollers 90, 90′ and 90″ arranged thereon, respectively, at a central lower portion and opposite lateral side portions of an arcuate upper notch 81 formed in its upper edge portion. The roller 90 that is arranged at the central lower portion of the roller holder 80 is supportedly fitted on an eccentric connecting member 91 which is formed of a one-piece member formed integrally with a cylindrical roller shaft 92 supporting the same roller 90, and a cylindrical connecting lever 93 (which corresponds to the connecting lever 21 in FIGS. 1 and 2) coupling the roller holder 80 with the injection timing control device T. The roller shaft 92 and connecting lever 93 of the eccentric connecting member 91 are integrally combined together in a manner eccentrical with each other so as to facilitate fitting the connecting member 91 onto the roller holder 80 and the injection timing control device T, referred to later. More specifically, the roller shaft 92 and the connecting lever 21 have their axes O1, O2 offset by a suitable distance l, as shown in FIG. 4.

Figure 5:
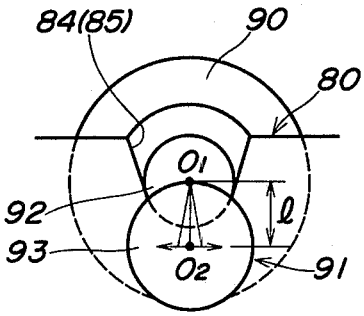
FIG. 5 is a view showing pivotal movement of the eccentric connecting member, as taken in the direction indicated by line V—V in FIG. 4.

The above-mentioned arcuate notch 81 is provided for the same purpose as the conventional notch previously referred to, that is, of avoiding interference of the roller holder 80 with the coupling gear coupling the drive shaft with the governor mechanism. The roller holder 80 comprises an outer annular holding portion 82 and an inner annular holding portion 83 arranged concentrically with each other. These holding portions 82, 83 have their one side surfaces each formed with three slits 84–84″, 85–85″, which extend radially of the roller holder 80 and are circumferentially arranged at predetermined intervals, e.g. at equal intervals of 120 degrees. Each of the slits 84–84″ is disposed opposite a corresponding one of the slits 85–85″. Of these slits, the paired slits 84′, 85′ and 84″, 85″ are located at circumferentially opposite sides of the notch 81, while the paired slits 84, 85 are located at a central lower edge portion of the roller holder 80 which is diametrically opposite to the notch 81. Fitted in these paired slits 84, 85; 84′, 85′; 84″, 85″ are end portions of roller shafts 92–92″, which support respective rollers 90–90″ rotatably fitted thereon. The connecting lever 93 of the eccentric connecting member 91 has its one end fitted in an engaging hole 94a formed in a holder 94 placed within an engaging hole 22a formed in a portion of the peripheral surface of the timer piston 22 opposite the roller holder 80, the holder 94 being in spherical contact with the engaging hole 22a for swivelling motion therein. The degree of eccentricity of the roller shaft 92 and connecting lever 93 of the eccentric connecting member 91, that is, the distance l between the diametric center $O_1$ of the roller shaft 92 and the diametric center $O_2$ of the connecting lever 93 as shown in FIG. 5 is determined by the positional relationship between the roller holder 80 and the timer piston 22 of the injection timing control device T, the diameters of the roller shaft 92 and connecting lever 93, etc. In the illustrated embodiment, the roller shaft 92 and connecting lever 93 are so arranged that the outer peripheral surface of the roller shaft 92 is located just on the diametric center $O_2$ of the connecting lever 93.

According to the above arrangement, while the connecting lever 93 and roller shaft 92 of the eccentric connecting member 91 are disposed in eccentricity of each other, the timer piston 22 of the injection timing control device T is disposed to move circumferentially of the roller holder 80. In addition, the roller shaft 92 is fitted in the slits 84 and 85 in the roller holder 80 in a manner being supported circumferentially of the roller holder 80. Therefore, as the connecting lever 93 engaging directly with the timer piston 22 is moved in the directions indicated by the arrows in FIG. 5 in unison with movement of the timer piston 22, it is acted upon, at its axis O1, by force counteracting its movement, that is, turning moment of the magnitude of $F \times l$ ($F$=the magnitude of the counteracting force, and $l$=the distance between the axes O1, O2). As a consequence, without pivotal movement-prohibiting means as hereinafter described, the connecting lever 93 can be pivoted about the axis O1, that is, the axis O2 is displaced substantially circumferentially of the roller holder 80. In other words, although the roller holder 80 should properly be displaced in a proportion of 1:1 with respect to displacement of the timer piston 22 of the injection timing control device T, it cannot accurately follow the displacement of the timer piston 22 due to the pivotal movement of the connecting lever 93.

Figure 6:
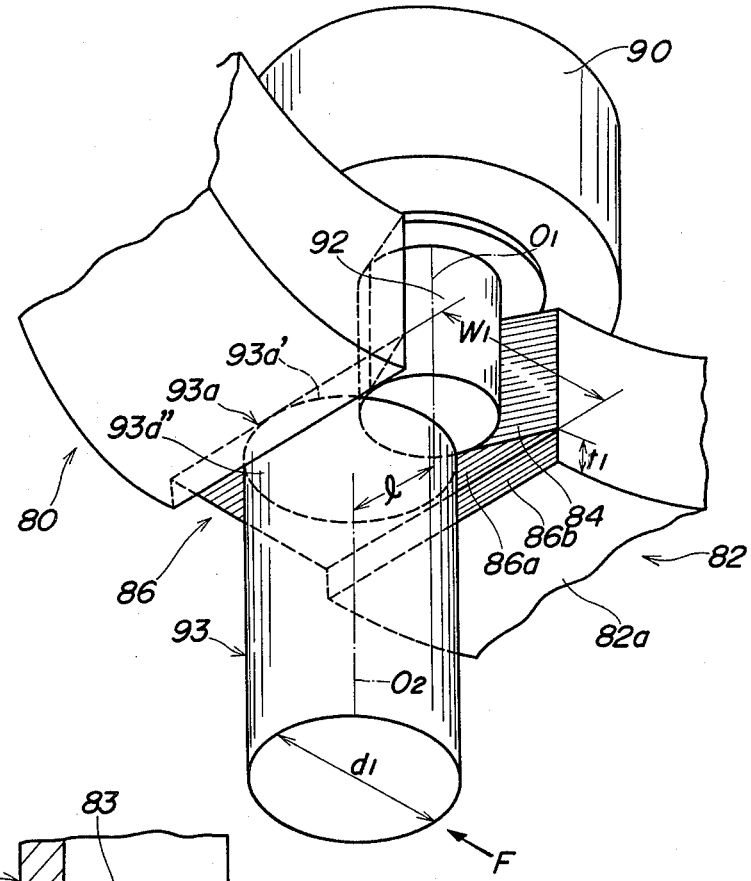
FIG. 6 is a persective view of the pivotal movement-prohibiting means of the fuel injection pump according to the first embodiment of the invention.

FIG. 6 clearly shows the pivotal movement-prohibiting means according to the present embodiment. A groove 86 is formed in a lower peripheral surface 82a of a central lower part of the outer annular holding portion 82 of the roller holder 80, which extends axially of the same holding portion 82, that is, of the roller holder 80, and in the bottom surface 86a of which opens the slit 84. This groove 86 has a width w1 substatially equal to the diameter d1 of the connecting lever 93. The depth t1 of the groove 86 is set at a suitable value for stably holding the connecting lever 93 within the groove 86 during movement of the timer piston 22. The connecting lever 93 has its end portion 93a fitted in the groove 86 with its corresponding end face 93a' and outer peripheral surface 93a'' in contact with the bottom surface 86a and the lateral side surfaces 86b, respectively. Thus, the connecting lever 93 is prevented from being dislocated circumferentially of the roller holder 80. Therefore, during movement of the timer piston 22, the connecting lever 93 will not be pivoted about the axis O1 of the roller shaft 92, despite turning moment of F×l acting upon the connecting lever 93 to rotate same about the axis O1. Since the circumferential displacement of the connecting lever 93 relative to the roller holder 80 is thus prohibited, the roller holder 80 is circumferentially displaced in a proportion of 1:1 with respect to displacement of the timer piston 22.

The other elements and parts of the fuel injection pump according to the invention are identical in construction and arrangement with those of the conventional fuel injection pump in FIGS. 1 and 2, description of which is therefore omitted.

Figure 7:
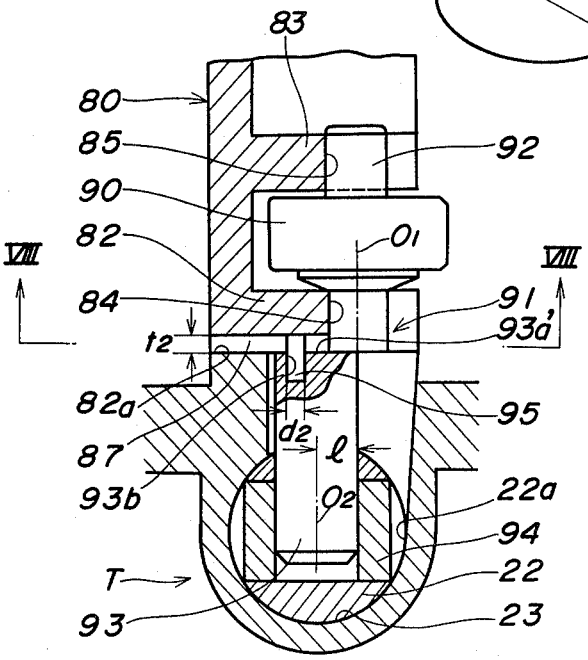
FIG. 7 is a longitudinal sectional view of pivotal movement-prohibiting means according to a second embodiment of the invention.
Figure 8:
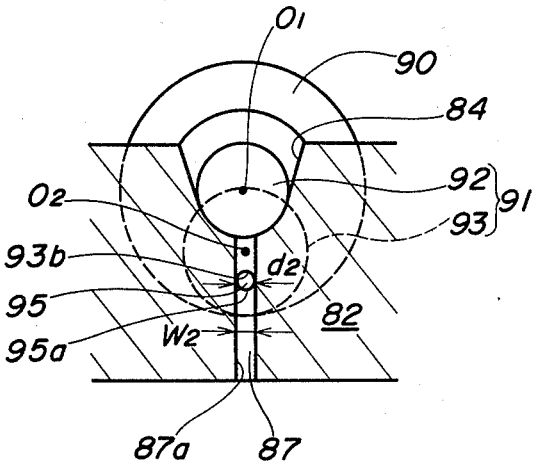
FIG. 8 is a sectional view taken along line VIII—VIII in FIG. 7.

FIGS. 7 and 8 show the pivotal movement-prohibiting means according to a second embodiment of the invention. An end face 93a' of the connecting lever 93 facing the roller shaft 92 is formed with a blind hole 93b extending parallel with the axis O2, in which is force fitted a pin 95. On the other hand, a narrow groove 87 is formed in the outer peripheral surface 82a of the outer annular holding portion 82 of the roller holder 80 and extends axially of the roller holder 80 while it is disposed in facing relation to the above end face 93a' of the connecting lever 93. This groove 87 has a width w2 much smaller than the diameter d1 of the connecting lever 93 and substantially equal to the diameter d2 of the pin 95, and a suitable depth t2 enough to stably hold the pin 95 in the blind hole 93b. The pin 95 is fitted in the groove 87 with its outer peripheral surface 95a in contact with the opposite inner lateral side surfaces 87a of the groove 87, and accordingly it is prevented from its circumferential movement, to thereby prohibit pivotal movement of the connecting lever 93 with respect to the roller shaft 92.

This second embodiment is advantageous over the first embodiment in that the width w2 of the groove 87 is small or substantially equal to the diameter d2 of the small-sized pin 95 to thereby obtain an adequate surface area of the slit 84 for supporting the roller shaft 92, whereas in the first embodiment the surface area of the slit 84 for supporting the roller shaft 92 is relatively small due to the presence of the groove 86 having a large width substantially equal to the diameter d1 of the connecting lever 93.

Figure 9:
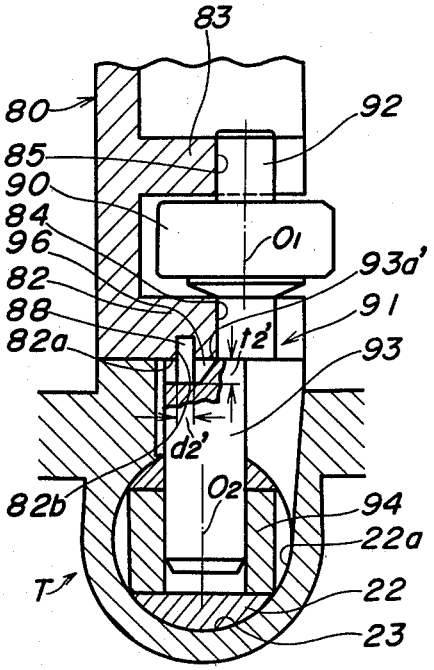
FIG.9 is a longitudinal sectional view of pivotal movement-prohibiting means according to a third embodiment of the invention.

FIG. 9 shows a third embodiment of the pivotal movement-prohibiting means of the invention. The outer annular holding portion 82 of the roller holder 80 has its outer peripheral surface 82a formed with a blind hole 82b having a diameter d2' which extends axially of the connecting lever 93 and is disposed in facing relation to the end face 93a' of the connecting lever 93. A pin 88 is force fitted in the blind hole 82b. On the other hand, the end face 93a' of the connecting lever 93 facing the roller holder 80 is formed with a groove 96 extending axially of the same holder 80. The groove 96 has a width substantially equal to the diameter d2' of the pin 88 and a suitable depth t2' enough to stably hold the pin 88 therein. In the same manner as the pin 95 in FIG. 8, the pin 88 is fitted in the groove 96 with its outer peripheral surface in contact with opposite inner lateral side surfaces of the groove 96, to thereby prohibit circumferential dislocation of the connecting lever 93 with respect to the roller shaft 92. Also this embodiment has the advantage of an increased surface area of the slit 84 for supporting the roller shaft 92.

Figure 10:
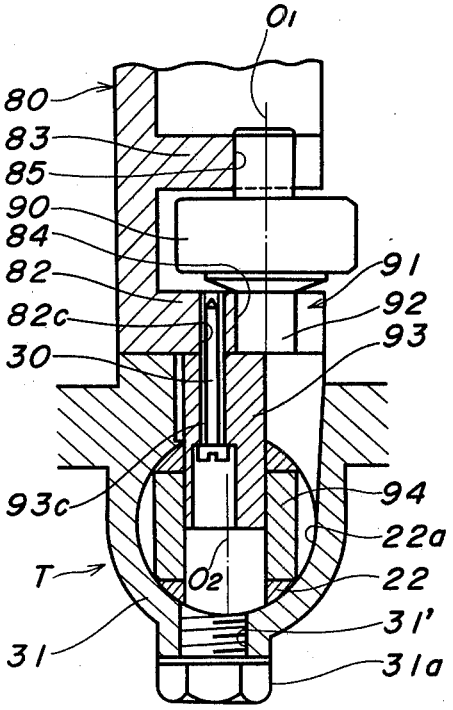
FIG. 10 is a longitudinal sectional view of pivotal movement-prohibiting means according to a fourth embodiment of the invention.

FIG. 10 shows a fourth embodiment of the pivotal movement-prohibiting means of the invention. A bolt-fitting through hole 93c is formed through the connecting lever 93 and extends axially of the latter, whereas a tapped hole 82c is formed through the outer annular holding portion 82 of the roller holder 80 in alignment with the through hole 93c. Further, a tapped hole 31' is formed through the wall 31 of the cylinder 23 of the injection timing control device T in alignment with the bolt-fitting hole 82c. A bolt 30 is fitted through the bolt-fitting hole 93c and threadedly fitted in the tapped hole 82c to rigidly join the connecting lever 93 to the roller holder 80 for movement in unison with the latter, thus prohibiting pivotal movement of the connecting lever 93 about the roller shaft 92. The bolt 30 is mounted into the connecting lever 93 through the tapped hole 31' in the cylinder wall 31, which hole is closed by a plug 31a after mounting of the bolt 30.

Figure 11:
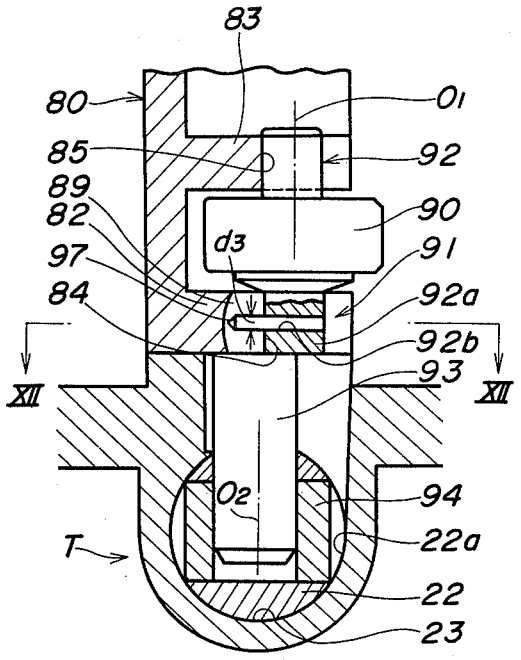
FIG. 11 is a longitudinal sectional view of pivotal movement-prohibiting means according to a fifth embodiment of the invention.
Figure 12:
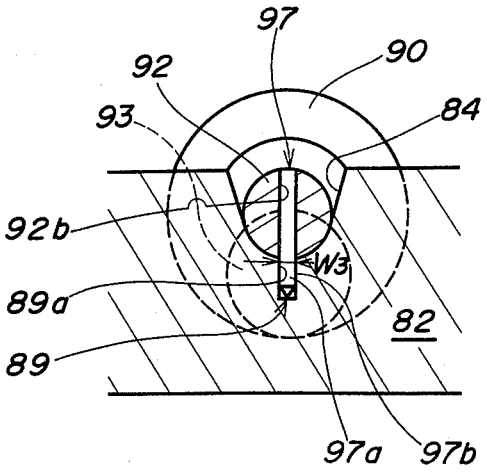
FIG. 12 is a sectional view taken along line XII—XII in FIG. 11.

FIGS. 11 and 12 show a fifth embodiment of the pivotal movement-prohibiting means of the invention. The outer annular holding portion 82 of the roller holder 80 is formed with a radial groove 89 opening in the inner peripheral surface of the slit 84 and extending through the same holding portion 82 over the whole radial width. On the other hand, a through hole 92b is formed through an end portion 92a of the roller shaft 92 facing the connecting lever 93, which extends diametrically of the roller shaft 92 and is disposed opposite the above groove 89. A pin 97 is force fitted through the hole 92b, while a portion 97a of the pin 97 is projected into the groove 89. The width w3 of the groove 89 is substantially equal to the diameter d3 of the pin 97 such that the portion 97a has its outer peripheral surface 97b disposed in contact with opposite inner lateral side surfaces of the groove 89 to force circumferential displacement of the connecting lever 93 in unison with the roller holder 80 via the roller shaft 92 integral with the lever 93.

Figure 13:
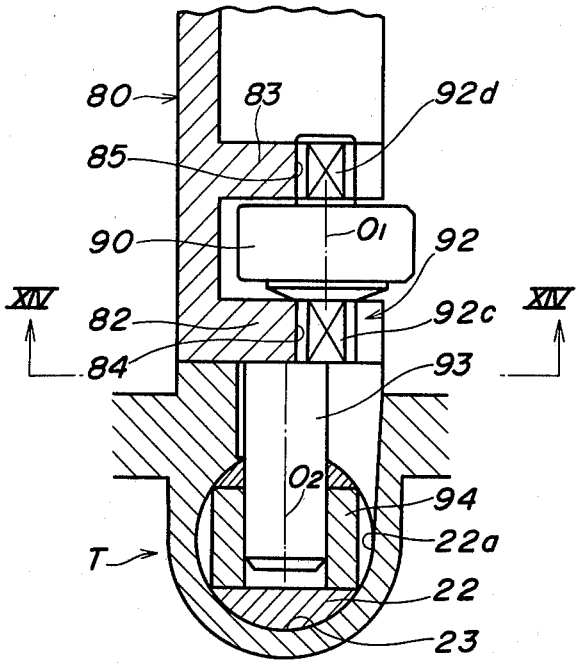
FIG. 13 is a longitudinal sectional view of pivotal movement-prohibiting means according to a sixth embodiment of the invention.
Figure 14:
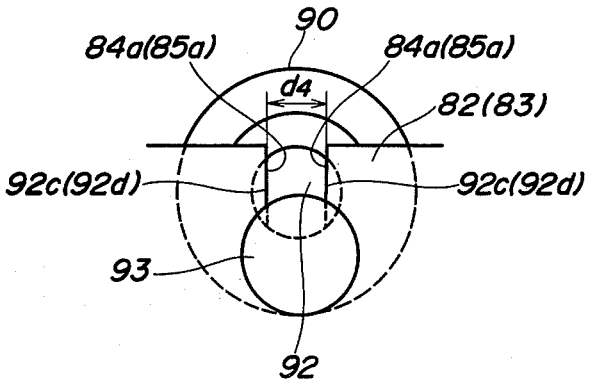
FIG. 14 is a view as viewed in the direction indicated by line XIV—XIV in FIG. 13.

FIGS. 13 and 14 show a sixth embodiment of the pivotal movement-prohibiting means of the invention. According to this embodiment, the slits 84, 85 formed, respectively, in the outer and inner annular holding portions 82, 83 of the roller holder 80 each have a substantilly rectangular cross section, wherein they each have opposite flat inner lateral side surfaces 84a, 84a; 85a, 85a extending axially of the roller holder 80. On the other hand, the opposite end portions of the roller shaft 92 each have opposite flatly chamfered lateral side surfaces 92c, 92c; 92d, 92d which are opposed to the inner lateral side surfaces 84a, 85a of the respective slit 84, 85. The distance d4 between the opposite chamfered surfaces 92c, 92c; 92d, 92d is substantially equal to that between the inner opposite surfaces 84a, 84a; 85a, 85a of the slits 84, 85. Therefore, the inner lateral side surfaces 84a, 85a are disposed in tight face-to-face contact with respective ones of the opposite chamfered surfaces 92c, 92*d*. Thus, the roller shaft 92 which is fitted in the slits 84, 85 is not rotatable relative to the roller holder 80, and accordingly the connecting lever 93 integral with the roller shaft 92 is not rotatable relative to the roller holder 80, either.

The engaging surfaces of the slits 84, 85 and the roller shaft 92, that is, the inner opposite surfaces 84*a*, 85*a* of the slits 84, 85 and the opposite surfaces 92*c*, 92*d* are not limited in design to those illustrated in FIGS. 13 and 14, but they may be designed otherwise insofar as they can engage with each other so as to prohibit rotation of the roller shaft 92 relative to the slits 84, 85.

The present invention may be applied to various distributor type fuel injection pumps designed for engines with a wide range of number of cylinders besides the three-cylinder type described above.

As set forth above, according to the invention, the connecting lever of the eccentric connecting member coupling the timer piston to the roller holder is prevented from pivoting about the roller shaft of the same connecting member by means of the pivotal movement-prohibiting means, to thereby ensure accurate displacement of the roller holder in exact response to displacement of the timer piston and therefore enable to achieve proper injection timing control in exact response to the rotational speed of the engine.

Obviously many modifications and variations of the present invention are possible in the light of the above teachings. It is therefore to be understood that within the scope of the appended claims the invention may be practiced otherwise than as specifically described.

What is claimed is:

1. A distributor type fuel injection pump for an internal combustion engine, comprising: a pumping plunger; a drive shaft disposed for rotation at speeds dependent upon the rotational speed of the engine; a cam disc having a camming surface, said cam disc being secured to said plunger and coupled to said drive shaft for rotation in unison therewith; a roller holder disposed for circumferential displacement about an axis thereof; a plurality of rollers carried by said roller holder in radial arrangement, said rollers being disposed in urging contact with said camming surface of said cam disc; injection timing control means having an element displaceable in response to the rotational speed of the engine; means connecting said roller holder with said displaceable element of said injection timing control means, said connecting means including an eccentric connecting member comprising a first portion and a second portion combined together in eccentricity with each other, said first portion engaging with said roller holder and supporting a predetermined one of said rollers rotatably fitted thereon, said second portion engaging with said displaceable element of said injection timing control means; and means for prohibiting pivotal movement of said second portion of said eccentric connecting member about said first portion thereof relative to said roller holder; wherein displacement of said displaceable element of said injection timing control means causes accurately corresponding circumferential displacement of said roller holder through said eccentric connecting member of said connecting means and said pivotal movement-prohibiting means.

2. A distributor type fuel injection pump as claimed in claim 1, wherein said roller holder has an outer peripheral surface, said pivotal movement-prohibiting means comprising a groove formed in said outer peripheral surface of said roller holder, said second portion of said eccentric connecting member having one end portion fitted in said groove to be prevented from moving circumferentially of said roller holder relative thereto.

3. A distributor type fuel injection pump as claimed in claim 2, wherein said roller holder has a radial slit formed therein, in which said first portion of said eccentric connecting member is fitted, said groove having a bottom surface in which said slit opens, and two opposite inner lateral side surfaces extending axially of said roller holder, said one end portion of said second portion of said eccentric connecting member has an outer peripheral surface disposed in contact with said two opposite inner lateral side surfaces of said groove.

4. A distributor type fuel injection pump as claimed in claim 1, wherein said roller holder has an outer peripheral surface, said pivotal movement-prohibiting means comprising a pin planted on one of one end face of said second portion of said eccentric connecting member facing said roller holder and a portion of said outer peripheral surface of said roller holder facing said one end face of said second portion, and a groove formed in the other of said one end face of said second portion and said portion of said outer peripheral surface, said pin having a portion thereof fitted in said groove, whereby said second portion of said eccentric connecting member is prevented from moving circumferentially of said roller holder relative thereto.

5. A distributor type fuel injection pump as claimed in claim 4, wherein said groove has two opposite inner lateral side surfaces extending axially of said roller holder, said portion of said pin having an outer peripheral surface disposed in contact with said two opposite inner lateral side surfaces of said groove.

6. A distributor type fuel injection pump as claimed in claim 1, wherein said roller holder has an outer peripheral surface, said pivotal movement-prohibiting means comprising a through hole formed through said second portion of said eccentric connecting member, and a tapped hole formed in said outer peripheral surface of said roller holder in alignment with said through hole, and a bolt fitted through said through hole and threadedly fitted in said tapped hole.

7. A distributor type fuel injection pump as claimed in claim 1, wherein said first portion of said eccentric connecting member has one end portion having an outer peripheral surface, said pivotal movement-prohibiting means comprising a groove formed in said roller holder in facing relation to said outer peripheral surface of said one end portion of said first portion of said eccentric connecting member, and a pin planted on said outer peripheral surface of said one end portion of said first portion of said eccentric connecting member, said pin having a portion thereof fitted in said groove, whereby said second portion of said eccentric connecting member is prevented from moving circumferentially of said roller holder relative thereto.

8. A distributor type fuel injection pump as claimed in claim 7, wherein said groove has two opposite inner lateral side surfaces extending axially of said roller holder, said portion of said pin having an outer peripheral surface disposed in contact with said two opposite inner lateral side surfaces of said groove.

9. A distributor type fuel injection pump as claimed in claim 1, wherein said first portion of said eccentric member has two opposite end portions, said roller holder having a pair of slits formed therein and circumferentially supporting said opposite end portions of said first portion of said eccentric connecting member fitted therein, said pivotal movement-prohibiting means having a first engaging surface formed on at least one of said opposite end portions of said first portion of said eccentric connecting member, and a second engaging surface formed on at least one of said slits corresponding to said at least one end portion and engaging with said first engaging surface, whereby said first portion of said eccentric connecting member is prevented from rotation within said slits.

10. A distributor type fuel injection pump as claimed in claim 9, wherein said first engaging surface comprises at least one flat surface forming an outer peripheral surface of said at least one end portion of said first portion of said eccentric connecting member, and said second engaging surface comprises at least one flat surface forming an inner peripheral surface of said at least one corresponding slit, said flat surface of said first engaging surface being disposed in face-to-face contact with said flat surface of said second engaging surface.

* * * * *